US006991107B2

(12) United States Patent
Harrelson

(10) Patent No.: US 6,991,107 B2
(45) Date of Patent: Jan. 31, 2006

(54) DISPENSING SYSTEM FOR DOUBLE STACK CARTON

(75) Inventor: Glen R. Harrelson, Gainesville, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 158 days.

(21) Appl. No.: 10/626,235

(22) Filed: Jul. 24, 2003

(65) Prior Publication Data

US 2004/0155098 A1 Aug. 12, 2004

Related U.S. Application Data

(63) Continuation-in-part of application No. 10/365,148, filed on Feb. 12, 2003, now Pat. No. 6,918,487.

(51) Int. Cl.
*B65D 65/00* (2006.01)

(52) U.S. Cl. ..... 206/427; 206/430; 221/305; 229/242

(58) Field of Classification Search ..... 206/427, 206/429–430, 160; 221/303, 305–309; 229/240–242
See application file for complete search history.

(56) References Cited

U.S. PATENT DOCUMENTS

| | | | | |
|---|---|---|---|---|
| 3,265,283 A | | 8/1966 | Farquhar | |
| 3,356,279 A | | 12/1967 | Root | |
| 4,318,474 A | | 3/1982 | Hasegawa | |
| 4,331,289 A | | 5/1982 | Killy | |
| 4,364,509 A | | 12/1982 | Holley, Jr. | |
| 4,396,143 A | | 8/1983 | Killy | |
| 4,498,581 A | | 2/1985 | Dutcher | |
| 4,577,799 A | | 3/1986 | Oliff | |
| 5,031,770 A | * | 7/1991 | Chaussadas | 206/429 |
| 5,246,113 A | * | 9/1993 | Schuster | 206/430 |
| 5,368,194 A | * | 11/1994 | Oliff et al. | 221/305 |
| 5,427,242 A | * | 6/1995 | Oliff et al. | 206/430 |
| 5,505,372 A | | 4/1996 | Edson | |
| 5,518,111 A | * | 5/1996 | Stout | 206/160 |
| 5,772,030 A | * | 6/1998 | Baxter | 206/427 |
| 5,826,782 A | * | 10/1998 | Stout | 206/427 |
| 5,826,783 A | * | 10/1998 | Stout | 206/427 |
| 6,478,219 B1 | | 11/2002 | Holley, Jr. | |
| 6,578,736 B2 | | 6/2003 | Spivey | |
| 6,669,083 B2 | | 12/2003 | Bates | |
| 6,715,639 B2 | | 4/2004 | Spivey | |

* cited by examiner

*Primary Examiner*—Bryon P. Gehman
(74) *Attorney, Agent, or Firm*—Womble Carlyle Sandridge & Rice, PLLC

(57) ABSTRACT

The carton of this invention is capable of carrying the plurality of containers stacked upon their ends in two tiers with a unique dispenser that permits the dispensing of containers on their sides. The dispenser is formed in a top side wall and extends into the end wall with most of the end wall being torn open but leaving a portion near the bottom side wall to prevent the bottom layer of containers from rolling out. Angled projections in the dispensing end of the carton near the top panel and bottom panel prevent the top layer of containers from rolling out. A divider is provided to facilitate loading the two tiers of containers and an end of the divider is folded down to facilitate its correct placement on the bottom tier of cans. A slit is provided between the two end portions of the divider so cans can be removed from the dispenser without being impeded by the divider being in the way.

40 Claims, 3 Drawing Sheets

DISPENSING SYSTEM FOR DOUBLE STACK CARTON

CROSS-REFERENCE TO RELATED APPLICATION

This application is a continuation-in-part of application Ser. No. 10/365,148 entitled, "Improved Dispensing System for Double Stack Carton," filed on Feb. 12, 2003, now U.S. Pat. No. 6,918,487, of which Glen R. Harrelson is listed as the inventor.

BACKGROUND OF THE INVENTION

1. Field of the Invention

The present invention relates generally to an enclosed paperboard carton capable of enclosing containers in two tiers, which carton has a unique opening and dispensing feature that allows the containers, for example, cans, to be removed or dispensed one container per tier at a time without destroying the overall structural integrity of the carton. The unique opening and dispensing feature can be incorporated in cartons containing a plurality of layers of containers stacked on end and still limit the dispensing to one container per tier at a time. This carton has a unique divider separating the two tiers which facilitates loading the containers in two tiers.

2. Background

Fully enclosed cartons capable of enclosing cans have been used in the past that have a feature for dispensing the cans one at a time. Dispensers have been provided at various locations on these cartons depending on the design.

Cartons have been introduced into the marketplace that can carry 24 or more containers, for example cans, in two stacks or tiers. So far no satisfactory dispenser has been developed for dispensing the layers of cans in these two stack cartons one at a time from each stack or tier. Consequently, when these cartons are opened they tend to let a number of the cans roll out which has not allowed these twin stack cartons to achieve their full potential.

INCORPORATION BY REFERENCE

This application incorporates by reference application Ser. No. 10/365,148 entitled "Improved Dispensing System for Double Stack Carton," filed on Feb. 12, 2003.

SUMMARY OF THE INVENTION

It is an object of this invention to develop a dispenser for dispensing containers, for example cans, one at a time from a carton containing containers in two stacks or tiers. It is the further object of this invention to develop a dispenser that can be easily opened. A further object of this invention is to develop a dispenser that can be used for containers stacked in a 3 by 4 configuration in each stack to be dispensed one at a time from each stack without the containers rolling out accidentally. Another object of this invention is to develop a dispenser for a twin stack carton that does not destroy the structural integrity of the carton when it is opened. It is a further object of this invention to develop a divider for separating the two tiers of containers to facilitate loading the containers into the carton from either the end where the dispenser is located or the other end of the carton.

Briefly described, in its preferred form, the objects of this invention are achieved by providing an enclosed carton for carrying containers in two tiers for dispensing the containers one at a time from each tier from the exiting end of the carton. The carton is generally rectangular and has a bottom, top, two sides, a closed end and exiting end. The carton is foldably constructed from a blank having panels and flaps. The carton is designed to carry containers, e.g. cans, that are stacked on their ends in two tiers from the bottom panel to the top panel. The dispenser is constructed by providing tear lines in one of the side panels that extend into the exiting end of the carton which is rested on the other side panel, with the dispenser being capable of dispensing the containers as they are resting on their sides. A tear line is provided in the end of the carton placed from the side upon which the carton rests while dispensing containers at a sufficient distance to prevent any of the containers below the top layer of containers from rolling out of the carton when the dispenser is open. A pair of tear lines extend from this bottom tear line from each end at an angle from the bottom tear line to the top side panel in which part of the dispenser is formed. The angle and distance of the projection is such as to restrain the top layer of cans in each tier from accidentally rolling out. The dispenser is constructed with a large enough opening in the top side panel in which it is formed to permit a person to grasp and remove a container in each tier one at a time.

This carton can be designed with a dispenser dispensing containers in a 3 by 4 configuration in each tier. The bottom tear line is located so as to prevent the bottom layers of containers from rolling out of the carton. A pair of tear lines extending from the ends of the bottom tear line are placed at an angle designed to restrain containers in the top layer from rolling out of the carton.

Because these two tiers of containers, such as cans, are loaded into one end of the carton after it has been formed from a blank and glued into a sleeve, a divider is desirable between the two tiers of containers to facilitate loading the containers into an end of the carton. The divider basically provides a surface on which the cans in the top tier can be loaded into the carton. Because both ends of the carton are open when the cans are loaded into the carton, a portion of the divider must be folded down immediately adjacent to the containers in the bottom tier on the end of the carton into which the containers are loaded. Otherwise, the two tiers of containers might not be properly aligned in the carton. Since these containers, such as cans, can be loaded from either the dispensing end or the non-exiting end of the carton, it is necessary to have some provision so the folded down end of the dispenser does not interfere with the dispensing of containers from the dispensing end when the folded down end of the divider is located adjacent the dispensing, or exiting end, of the carton. This is accomplished by placing a slit in the end of the divider that is to be located adjacent the dispensing end of the carton. Since it may not be known from which end the carton may be loaded, it is preferable to have the slit on each end of the divider. If the folded down end of the divider is located adjacent the dispenser, the portion of the dispenser on the side of the slit adjacent the dispenser opening can be moved to one side so that containers in the other tier can be removed without being impeded by the divider. Since the containers are dispensed while the carton is resting on a bottom side panel, the slit in the divider should be located so that it can be moved back and forth from one side of the dispenser to the other in order that containers may be removed from each tier of containers.

The divider of this invention can be utilized with dispensers other than those described above.

Preferably the exiting end of the carton has four flaps for closing this end. An end flap attached to the side of the carton on which it is resting while the containers are being dispensed is generally not removed and serves to restrain one or more of the bottom layers of containers from rolling out of the carton. Preferably the tear lines in the end flaps attached to the top panel, and bottom panel are constructed so that a portion of each of these flaps is not removed and are glued to the flap attached to the side panel on which the carton rests during dispensing to preserve the integrity of the carton.

Other objects, features and advantages of this invention will become apparent upon reading the following specification, when taken in conjunction with the accompanying drawings.

DETAILED DESCRIPTION OF THE PREFERRED EMBODIMENTS

The present invention is intended primarily for use with cans of the types used to contain soft drinks, beer and the like. The blank for forming the carton of this invention is illustrated and described in detail in U.S. application Ser. No. 10/365,148 which has been incorporated by reference. Numbers less than 100 used to describe parts of the carton in that application are used in this application. Numbers above 100 are used to describe features not disclosed, or not disclosed in detail, in that application.

Figure 1:
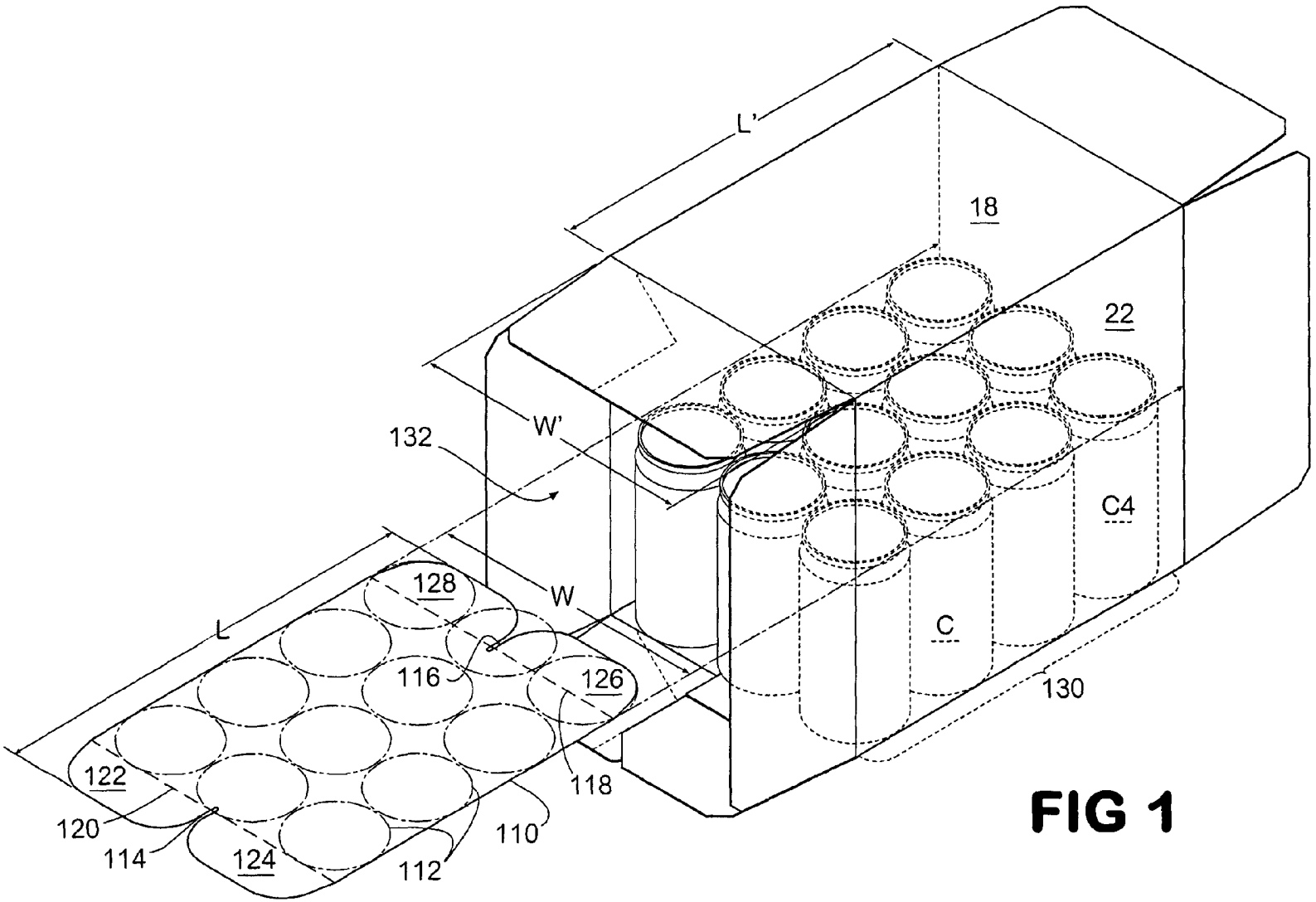
FIG. 1 is a perspective view of the carton of this invention showing the bottom tier of cans placed in the carton, and showing a plan view of the divider, which shows its position for inserting into the carton.
Figure 2:
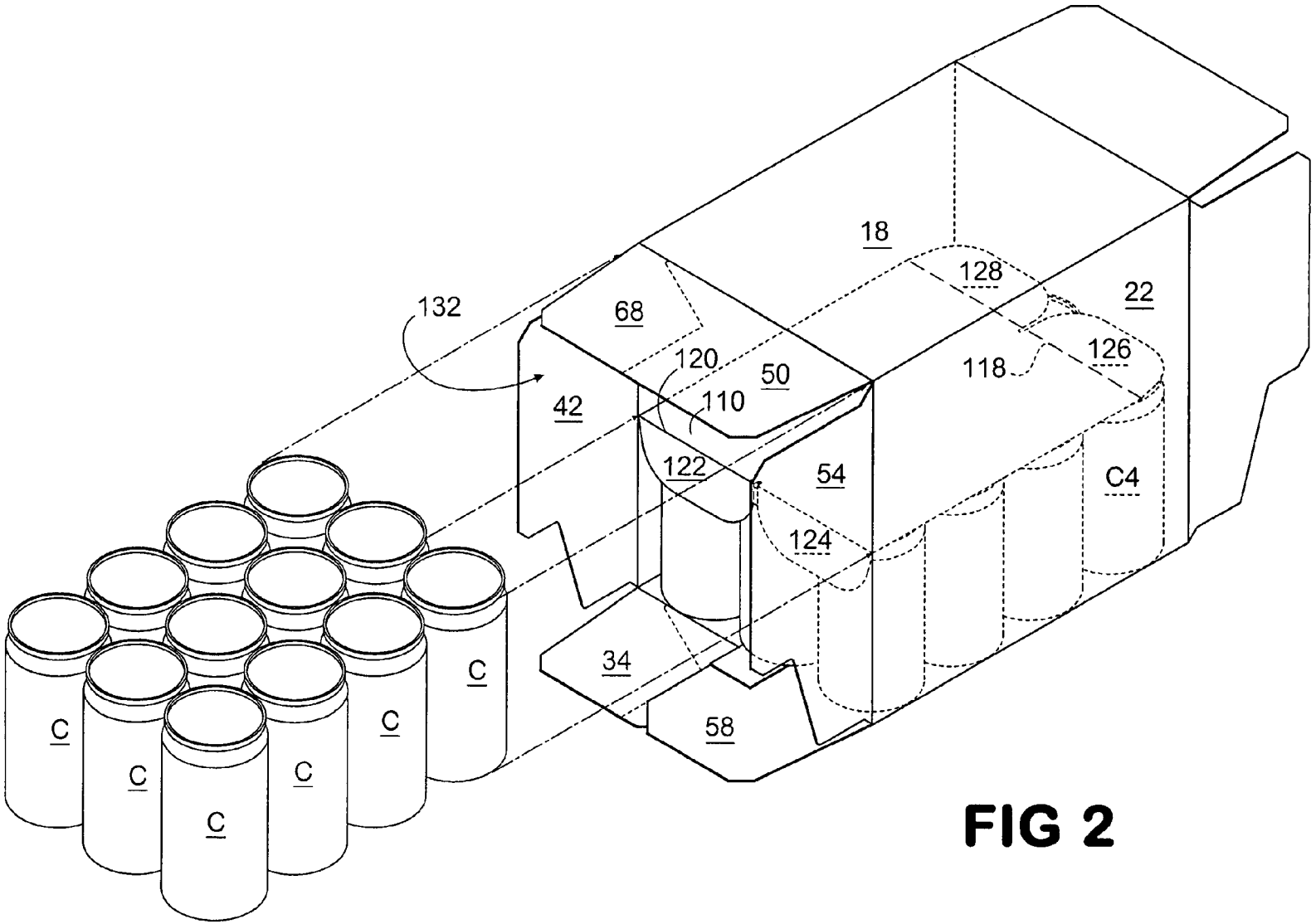
FIG. 2 is a perspective view of the carton of FIG. 1 in which the divider has been inserted on top of the first tier of cans.

FIG. 1 illustrates the carton having been formed from a blank and glued together and formed into an open ended sleeve. As shown in FIG. 1 the bottom panel 18 is shown in the top position, but it should be understood that the carton can be loaded with the bottom panel 18 in the bottom position. The divider 110 is shown in the proper position for insertion into the carton. Phantom lines 112 showing the location of the cans in the second tier are illustrated on divider 110. The divider 110 has a width W slightly less than the width W' of the carton so that the divider can be inserted into the carton. The width W of the carton between the bottom side panels 14 and 22 as shown in FIG. 1 is approximately equal to the sum obtained by multiplying the diameter of the container by the number of layers in a tier. The divider 110 can be inserted into the carton as illustrated in FIG. 2. The cans C can be inserted into the carton and placed on top of the divider 110 or the cans C can be placed on the divider 110 and inserted into the carton together. The divider has a length L as illustrated in FIG. 1 that is slightly greater than the length L' of the carton. The length L of the carton as shown in FIG. 1 is approximately the sum of the diameters of containers in a layer.

When the divider 110 is being inserted into the carton either with or without cans on it, the top end 122 of the divider 110 is folded down along with the bottom end 124 of the divider along fold line 120. A slit 114 is placed between top end 122 and bottom end 124 of the divider 110. As illustrated in FIG. 2, the fold line 120 is placed so that the divider 110 rests on the bottom tier 130 of the cans. In this case, the cans are being loaded through the exiting end, or dispensing end, 132 of the carton. It will be noticed that the non-exiting ends 126 and 128 of the divider do not extend beyond the end can C4. The fold line 120 is placed in the divider 110 so that the remainder of the divider 110 just covers the bottom tier of cans 130 in the carton. Fold line 118 is placed in a similar position in the divider 110, and in case that end of the divider is inserted last the non-exiting ends 126 and 128 of the divider would be turned down to properly locate the divider 110 in the carton. Slit 116 is placed between non-exiting ends 126 and 128 of the divider 110.

A handle (not shown) may be provided for carrying the carton.

The various end flaps of the carton can then be closed and sealed with glue in the conventional fashion. To use the end of the carton where the dispenser is located as an example, the top side flap 42 is folded inwardly, bottom side flap 54 is folded inwardly, bottom end flap 50 is folded in an overlapping position, and glued to top side flap 42 and bottom side flap 54. Outside top end flap 34 and inside top end flap 58 are glued together to form a single top end flap which is likewise glued to top side flap 42 and bottom side flap 54. The other end of the carton is closed in the same manner.

Figure 3:
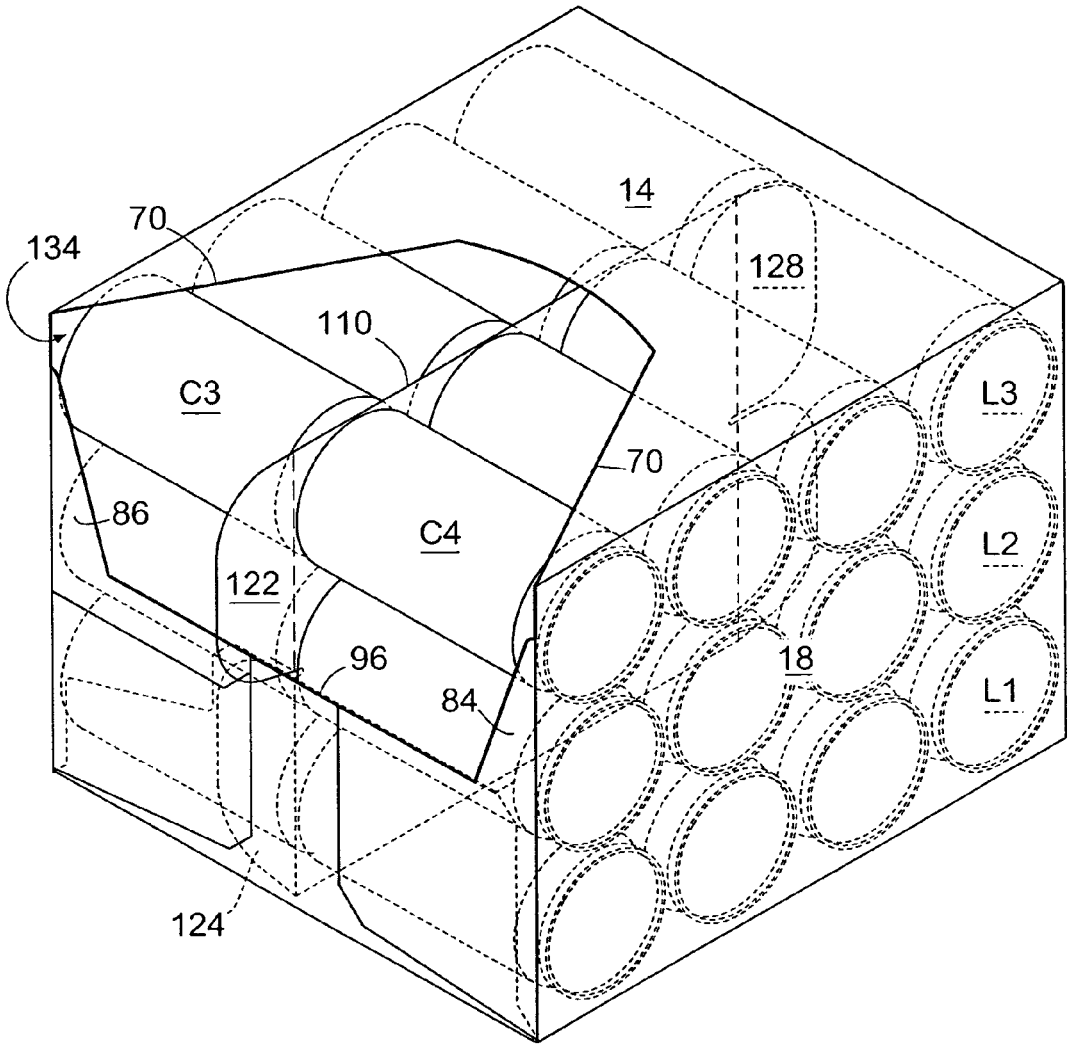
FIG. 3 is a perspective view of the carton into which both tiers of cans have been inserted with the carton resting on its bottom side panel with the dispenser flap having been torn open and removed exposing the dispenser opening.

FIG. 3 illustrates the carton that has been loaded with cans and turned 90 degrees so that it rests on bottom side panel 22. FIG. 3 illustrates the dispenser flap 68 having been opened exposing a dispenser opening 134. The dispenser flap 68 is partially formed in top side panel 14 as shown by tear line 70. It has been torn open as illustrated FIG. 3.

When the dispenser is opened, dispenser flap 68, which includes top side flap 42, is removed from the carton along with a portion of outside end flap 34 and bottom end flap 50 along tear line 70. It will be noticed that this carton has end retention projections 84 and 86 for holding cans in layers L2 and L3 from rolling out of the carton automatically once the dispenser flap 68 has been removed. The bottom tear line 96, which is torn open when the dispenser flap 68 is removed, needs to be located so that cans in the bottom layer L1 do not automatically roll out of the carton when the dispenser flap 68 has been removed. It will be noticed top end 122 of the divider 110 and the bottom end 124 of the divider 110 have been folded when the exiting end 132 of the carton is closed. Once a dispenser flap 68 is removed, the top end 122 of the divider 110 is an impediment to the removal of cans from the carton. The provision of slit 114 in the divider 110 permits the top end 122 of the divider 110 to be moved to the right so that can C3 can be removed. Likewise, the top end 122 of the divider 110 can be moved to the left allowing the removal of can C4 from the carton. It should be noted that slit 114 needs to be located in relation to bottom tear line 96 so the movement of top end 122 of the divider 110 is not impeded. In other words, the slit 114 should be located so that the top end 122 of the divider 110 can easily be moved to the right or to the left. Alternatively, a person may tear the top end 122 of the divider 110 off.

The divider 110 of this invention can be used for other types of dispensers where containers are stacked in two tiers. While the carton is illustrated as containing 24 cans, the carton can be designed to carry a different of multiple of cans.

While the invention has been disclosed in its preferred forms, it will be apparent to those skilled in the art that many modifications, additions, and deletions can be made therein without departing from the spirit and scope of the invention and its equivalents as set forth in the following claims.

Therefore, having thus described the invention, at least the following is claimed:

1. An enclosed carton for carrying a plurality of cylindrical containers each with two ends and a diameter, and an axis between the ends, with the containers stacked upon their ends in two tiers with a plurality of layers of containers in each tier, the carton having two ends, at least one of which is an exiting end capable of permitting containers to exit the carton, the carton having a length between the two ends approximately equal to the sum of the diameters of the number of containers to be contained in a layer in a tier, the carton comprising:

a. a bottom panel, a top panel, a bottom side panel adjacent to said bottom panel and said top panel, and a top side panel adjacent to said bottom panel end said top panel, the carton having a width between the bottom side and top side panels approximately equal to the sum obtained by multiplying the diameter of a container to be contained in a layer by the number of layers in a tier, the carton being designed so that the axes of the cylindrical containers are perpendicular to said bottom panel when placed in the carton;

b. said exiting end having a bottom tear line that extends at least partially across said exiting end spaced from said bottom side panel on which the carton is designed to rest when dispensing containers at a distance from said bottom side panel sufficient to restrain at least the layer of containers adjacent said bottom side panel from rolling out, a tear line in said exiting end extending from said bottom tear line adjacent to said top panel into said top side panel a sufficient distance and location to permit a person to grasp and remove a container one at a time from the tier that is adjacent said top side panel, said tear line extending into said exiting end adjacent said bottom panel, with all of said tear lines being interconnected to form a dispenser;

c. a divider to be placed between the tiers of containers as the carton is filled with containers, the divider having a width slightly less than the width of the carton, the divider having a length greater that the length of the carton, the divider having two ends, with one end to be placed adjacent the exiting end of the carton, said one end having a split that extends a distance into the divider so that said one end of the divider can be folded so it is perpendicular to the rest of the divider, with a portion of said one end of the divider being on one side of the split, said portion being located adjacent to where the dispenser is opened by tearing the tear lines, said split in the divider being located so that said portion of the divider can be moved to be adjacent one tier of containers so containers in the other tier can be removed from the carton without being impeded by the divider when the dispenser is open; and d. means to close the carton.

2. The carton of claim 1 in which the divider has a split on each end that extends a distance into the divider.

3. The carton of claim 1 in which the tear line in said exiting end which extends from said bottom tear line adjacent to said top panel is spaced far enough from said top panel to prevent the containers in the layer adjacent said top panel in the tier adjacent said top panel from rolling out when said dispenser is open, said tear line which extends into said exiting end adjacent said bottom panel being spaced far enough from said bottom panel to prevent the containers the layer adjacent said top side panel in the tier adjacent said bottom panel from rolling out when said dispenser is open, with the location of the bottom tear line and tear line adjacent said top panel and tear line adjacent said bottom panel being such to prevent or retain all of the containers in the carton from accidentally rolling out when the dispenser is open.

4. The carton of claim 3 in which the split in the divider is located in relation to the bottom tear line so said portion of the divider located adjacent to the dispenser can be moved to be adjacent one tier of containers so containers in the other tier can be removed from the carton without being impeded by the divider when the dispenser is open.

5. The carton of claim 4 in which the divider has a split in each end that extends a distance into the divider.

6. The carton of claim 1 in which all of the layers of containers in each tier except for the top layer are prevented from rolling out when the dispenser is open by said bottom tear line being placed a sufficient distance from said bottom side panel with the top layer of containers in each tier being prevented from rolling out by the placement of the tear lines in the exiting end adjacent said top panel and said bottom panel.

7. The carton of claim 1 which is designed to hold the containers in each tier at a height of three containers adjacent the exiting end with the bottom tear line spaced a sufficient distance from the bottom side panel to prevent the containers in each tier adjacent the bottom side panel and exiting end and the containers immediately above it and adjacent the exiting end from rolling out when the dispenser is open.

8. The carton of claim 7 in which:

a. said tear line in said exiting end of the carton adjacent said top panel extends at an angle and location from said bottom tear line to the top line between said top panel and said exiting end and extends along said top line until it reaches the top side panel where said tear line extends into said top side panel, said angle and location from said bottom tear line being sufficient to prevent the containers adjacent said dispenser on top of the two layers of containers in the tier adjacent said top panel from rolling out but permitting the containers to be grasped for removal when the dispenser is open; and b. said tear line in said exiting end adjacent said bottom panel extends at an angle and location from said bottom tear line to the bottom line between said bottom panel and said exiting end and extends along said bottom line until it reaches the top side panel where said tear line extends into said top side panel, said angle and location from said bottom tear line adjacent said dispenser being sufficient to prevent the container adjacent the dispenser on top of the two layers of containers in the tier adjacent said bottom panel from rolling out but permitting the container to be grasped for removal when the dispenser is open.

9. The carton of claim 1 which has only one exiting end.

10. An enclosed carton for carrying a plurality of containers, each with two ends and an axis between the ends, with the containers stacked upon their ends in two tiers with a plurality of layers of containers in each tier, the carton having two ends at least one of which is an exiting end, the carton having a length between the two ends approximately equal to the sum of the diameters of the number of containers to be contained in a layer in a tier, with a dispenser capable of permitting containers to exit one at a time from each tier, the carton comprising:

a. a bottom panel, a top panel, a bottom side panel adjacent to said bottom panel and said top panel, and a top side panel adjacent to said bottom panel and said top panel, the carton having a width between the bottom side and top side panels approximately equal to the sum obtained by multiplying the diameter of a container to be contained in a layer by the number of layers in a tier, with the carton being designed so the axes of the containers are perpendicular to said bottom panel when placed in the carton;

b. said exiting end having four flaps for closing the end, with a bottom side flap foldably attached to said bottom side panel, a top side flap foldably attached to said top side panel, a top end flap foldably attached to said top panel, a bottom end flap foldably attached to said bottom panel, said dispenser being formed by a pair of tear lines extending from a location in said top side panel a sufficient distance and location from its foldable attachment to said top side flap so as to permit a person to grasp a container in each tier adjacent said dispenser when open and remove the container, one of said pair of tear lines extending into said bottom end flap adjacent said bottom panel but leaving a projection in said bottom end flap which is attached to said bottom panel so that when said dispenser is open, the projection prevents at least the container adjacent said top side panel in the tier of containers adjacent said bottom panel and dispenser from rolling out when said dispenser is open, the other of said pair of tear lines extending into said top end flap adjacent said top panel but leaving a projection in said top end flap which is attached to said top panel so that when the dispenser is open the projection prevents at least the container adjacent the top side panel in the tier of containers adjacent the top panel and dispenser from wiling out when the dispenser is open, said pair of tear lines then extending towards each other so the portion of said top end flap between the tear lines in said top end flap and said top side flap is removed when the dispenser is open, and the portion of the bottom end flap between the tear line in said bottom end flap and said top side flap is removed when the dispenser is open and the portion of said top side panel between the tear lines in the top side panel and the entire top side flap are removed, with the bottom side flap remaining intact when the dispenser is opened, and said bottom side flap having sufficient height to prevent at least the layer of containers adjacent the bottom side panel from rolling out of the carton when said dispenser is open with the location of all the tear lines being arranged so that none of the containers roll out when the dispenser is open;

c. a divider to be placed between the tiers of containers as the carton is filled with containers, the divider having a width slightly less than the width of the carton, the divider having a length greater than the length of the carton, the divider having two ends, with one end to be placed adjacent the exiting end of the carton, said one end having a split that extends a distance into the divider so that said one end of the divider can be folded so it is perpendicular to the rest of the divider, with a portion of said one end of the divider being on one side of the split, said portion being located adjacent to where the dispenser is opened by tearing the tear lines, said split in the divider being located so that said portion of the divider can be moved to be adjacent one tier of containers so containers in the other tier can be removed from to carton being impeded by the divider when the dispenser is open; and d. means to close the carton.

11. The carton of claim 10 in which the height of the bottom end flap is sufficient to prevent all but the top layer of containers from rolling out when the dispenser is open and the projections is said top end flap and said bottom end flap are sufficient to prevent the containers in the top layer from rolling out when the dispenser is open.

12. The carton of claim 10 in which the divider has a split on each end that extends a distance into the divider.

13. The carton of claim 12 in which the split in the divider is located in relation to the bottom tear line so said portion of the divider located adjacent to the dispenser can be moved to be adjacent one tier of containers so containers in the other tier can be removed from the carton without being impeded by to divider when the dispenser is open.

14. An enclosed carton with 24 cylindrical containers, each with two ends and a diameter, and an axis between the ends, with the containers stacked upon their ends in two tiers with three layers of containers in each tier, to carton having two ends at least one of which is an exiting end, with a dispenser capable of permitting containers to exit one at a time from each tier, the carton having a length between the two ends approximately equal to the sum of the diameters of four containers, the carton comprising:

a. a bottom panel, a top panel, a bottom side panel adjacent to said bottom panel and said top panel, and a top side panel adjacent to said bottom panel and said top panel, the carton having a width between the bottom side and top side panels approximately equal to the sum of the diameters off three containers, with the carton being designed so the axes of the cylindrical containers are perpendicular to said bottom panel when placed in the carton;

b. said carton containing 24 containers, with 12 of said containers in a 3 by 4 configuration in each tier;

c. said exiting end having four flaps for closing the end, with a bottom side flap foldably attached to said bottom side panel, a top side flap foldably attached to said top side panel, a top end flap foldably attached to said top panel, a bottom end flap foldably attached to said bottom panel, said dispenser being formed by a pair of tear lines extending from a location in said top side panel a sufficient distance and location from its foldable attachment to said top side flap so as to permit a person to grasp a container in each tier adjacent said dispenser when open and remove the container, one of said pair of tear lines extending into said bottom end flap adjacent said bottom panel but leaving a projection in said bottom end flap which is attached to said bottom panel so that when said dispenser is open, the projection prevents at least the container adjacent said top side panel in the tier of containers adjacent said bottom panel and dispenser from rolling out when said dispenser is open, the other of said pair of tier lines extending into said top end flap adjacent said top panel but leaving a projection in said top end flap which is attached to said top panel so that when the dispenser is open the projection prevents at least the container adjacent the top side panel in the tier of containers adjacent the top panel and dispenser from rolling out when the dispenser is open, said pair of tear lines then extending towards each other so the portion of said top end flap between the tear lines in said top end flap and said top side flap is removed when the dispenser is open, and the portion of the bottom end flap between the tear lines in said bottom end flap and said top side flap is removed when the dispenser is open and the portion of said top side panel between the tear lines in the top side panel and the entire top side flap are removed, with the bottom side flap remaining intact when the dispenser is opened, and said bottom side flap having sufficient height to prevent at least the layer of containers adjacent the bottom side panel from rolling out of the carton when said dispenser is open with the location all the tear lines being arranged so that none of the containers roll out when the dispenser is open;

d. a divider between the two tiers of containers, the divider having a width slightly less than the width of the carton, the divider having a length greater than the length of the carton, the divider having two ends, with one end being adjacent the exiting end of the carton, said one end having a split that extends a distance into the divider so that said one end of the divider can be folded so it is perpendicular to the rest of the divider, with the portion of said one end of the divider on one side of the split being located adjacent to the dispenser, said split in the divider being located so that said portion of the divider can be moved to be adjacent one tier of containers so containers in the other tier can be removed from the carton without being impeded by the divider when the dispenser is open; and e. means to close the carton.

15. The carton of claim 14 in which the divider has a split on each end that extends a distance into the divider.

16. The carton of claim 14 in which the height of the bottom end flap is sufficient to prevent all but the top layer of containers from rolling out when the dispenser is open and the projections is said top end flap and said bottom end flap are sufficient to prevent the containers in the top layer from rolling out when the dispenser is open.

17. The carton of claim 14 in which the tear lines in the bottom end flap and top end flap turn towards each other as viewed when the carton is erected, after forming said projections so as to leave a portion of material out of which the carton is constructed for attachment to said bottom side flap so the exiting end of the carton is held secure when said dispenser is open.

18. The carton of claim 14 in which the tear lines in the top end flap and bottom end flap extend towards each other as viewed when the carton is erected to form a bottom tear line with two ends with the end of the tear line in said top end flap being angled toward the top side flap and at a location to form the projection to prevent the rolling out of a container in the top layer adjacent the top panel and then intersecting the fold line between said top panel and top end flap and extending along the fold line until it enters the top side panel, and the end of the tear line in the bottom end flap being angled towards the top side flap and at a location to form the projection to prevent the rolling out of a container in the top layer adjacent the bottom panel and then intersecting the fold line between said bottom panel and bottom end flap and extending along the fold line until it enters into said top side panel.

19. The carton of claim 14 in which the bottom end flap has sufficient height to prevent the layer of containers adjacent the bottom side flap and the layer immediately above such layer from rolling out of the carton when said dispenser is open.

20. An enclosed carton and a plurality of containers arranged in said carton in at least a first tier and a second tier, said carton comprising:

a bottom panel;

a bottom side panel adjacent to said bottom panel;

a top panel adjacent to said bottom side panel;

a top side panel extending between said bottom panel and said top panel;

a plurality of flaps closing a first end and a second end of said carton; and a divider located between said first and second tiers of containers, said divider having a first divider end, a central portion, and a second divider end, the central portion separated from each divider end by a pivotable fold line, said first divider end having a first split that divides said first divider end into a first top end and a first bottom end, wherein the first top end is pivotable with respect to the first bottom end, and the first top and bottom ends are pivotable with respect to the central portion.

21. The enclosed carton and plurality of containers of claim 20, wherein said divider has a width slightly less than a width of said carton, and wherein said first divider end is adjacent to the first end of the carton, and the second divider end is adjacent to the second end of the carton.

22. The enclosed carton and plurality of containers of claim 20, wherein said plurality of containers comprises twenty-four containers.

23. The enclosed carton and plurality of containers of claim 20, wherein said second divider end has a second split that divides said second divider end into a second top end and a second bottom end, the second top end being pivotable with respect to the second bottom end.

24. The enclosed carton and plurality of containers of claim 20, wherein said carton comprises at least one tear line defining a dispenser opening at said first end of said carton, and wherein said first divider end is adjacent to the first end of the carton, and the second divider end is adjacent to the second end of the carton.

25. The enclosed carton and plurality of containers of claim 24, wherein said at least of the tear line comprises a bottom tear line that extends across a width of said carton adjacent to said first split.

26. The enclosed carton as plurality of containers of claim 20, wherein said split is an aperture.

27. The enclosed carton and plurality of containers of claim 20, wherein said split extends along a length of said divider, and said first top end and said first bottom end are disposed along a width of said divider.

28. The enclosed carton and plurality of containers of claim 20, wherein said first top end and said first bottom end are foldably connected at a common edge of said divider.

29. The enclosed carton and plurality of containers of claim 20, wherein said split extends to the central portion.

30. An enclosed carton and plurality of containers arranged in said carton in at least a first tier and a second tier, said carton comprising:

a bottom panel;

a bottom side panel adjacent to said bottom panel;

a top panel adjacent to said bottom side panel;

a top side panel extending between said bottom panel and said top panel;

a plurality of flaps closing a first end and a second end of said carton; and a divider located between said first and second tiers of containers, said divider having a first divider end and a second divider end, said first divider end having a first split that divides said first divider end into a first top end and a first bottom end, wherein said first top end and said first bottom end are folded about at least one fold line with respect to a remainder of said divider.

31. The enclosed carton and plurality of containers of claim 30, wherein said first tier of containers comprises a bottom layer and a top layer of containers, said first top end being adjacent to said top layer, and said first bottom end being adjacent to said bottom layer.

32. The enclosed carton and plurality of containers of claim 30, wherein axes of said containers are substantially perpendicular to said remainder of said divider.

33. A method of removing containers from an enclosed carton, the method comprising:

providing an enclosed carton and a plurality of containers comprising: a bottom panel; a bottom side panel adjacent to said bottom panel; a top panel adjacent to said bottom side panel; a top side panel extending between said bottom panel and said top panel; a plurality of flaps closing a first end and a second end of said carton; a divider; a first tier of containers; and a second tier of containers, wherein the divider is located between said first and second tiers of containers, said divider having a first divider end and a second divider end, said first divider end having a first split that divides said first divider end into a first top end and a first bottom end, wherein said first top end and said first bottom end are folded about at least one fold line with respect to a remainder of said divider;

removing a portion of said first end of said carton to form a dispenser opening in said carton;

at least partially unfolding at least one of said first top end and said first bottom end to allow said containers to the removed from said carton; and removing said containers from said carton.

34. The method of claim 33, wherein said first tier of containers comprises a bottom layer and a top layer of containers, said first top end being adjacent to said top layer, and said first bottom end being adjacent to said bottom layer.

35. The method of claim 33, wherein axes of said containers are substantially perpendicular to said remainder of said divider.

36. The method of claim 33, wherein said second divider end has a second split that divides said second divider end into a second top end and a second bottom end.

37. A method of loading containers into a carton, the method comprising:

providing an open carton comprising: a bottom panel; a bottom side panel adjacent to said bottom panel; a top panel adjacent to said bottom side panel; a top side extending between said bottom panel and said top panel; a first plurality of flaps at a first end of said carton and a second plurality of flaps at a second end of said carton;

providing a divider having a first divider end and a second divider end, said first divider end having a first split that divides said first divider end into a first top end and a first bottom end;

loading a first tier of containers, said divider, and a second tier of containers in said open carton so that said divider separates said first and second tiers, and so that said first top end and said first bottom end are folded about at least one fold line with respect to a remainder of said divider; and closing said first and second ends of said carton with said first and second plurality of flaps.

38. The method of claim 37, wherein said first tier of containers comprises a bottom layer and a top layer of containers, said first top end being adjacent to said top layer, and said first bottom end being adjacent to said bottom layer.

39. The method of claim 37, wherein axes of said containers are substantially perpendicular to said remainder of said divider.

40. An enclosed carton and a plurality of containers arranged in said carton in at least a first tier and a second tier, said carton comprising:

a bottom panel;

a bottom side panel adjacent to said bottom panel;

a top panel adjacent to said bottom side panel;

a top side panel extending between said bottom panel and said top panel;

a plurality of flaps closing a first end and a second end of said carton; and a divider located between said first and second tiers of containers, said divider having a first divider end and a second divider end, said first divider end having a first split that divides said first divider end into a first top end and a first bottom end, wherein said first top end and said first bottom end are pivotable about at least one fold line that extends generally transverse to said split.

* * * * *